US006923329B2

(12) United States Patent
Aikawa

(10) Patent No.: US 6,923,329 B2
(45) Date of Patent: Aug. 2, 2005

(54) SCREEN APPARATUS

(75) Inventor: Yoshihiko Aikawa, Shizuoka (JP)

(73) Assignee: Aikawa Iron Works Co., Ltd., Shizuoka (JP)

( * ) Notice: Subject to any disclaimer, the term of this patent is extended or adjusted under 35 U.S.C. 154(b) by 129 days.

(21) Appl. No.: 10/368,356

(22) Filed: Feb. 20, 2003

(65) Prior Publication Data

US 2004/0079682 A1 Apr. 29, 2004

(30) Foreign Application Priority Data

Oct. 23, 2002 (JP) ..... 2002-308174

(51) Int. Cl.[7] ..... B07B 1/20
(52) U.S. Cl. ..... 209/273; 209/305; 209/306
(58) Field of Search ..... 209/255, 257, 209/270, 273, 303, 304, 305, 306; 210/411, 413, 414

(56) References Cited

U.S. PATENT DOCUMENTS 817,333 A * 4/1906 Orrman ..... 209/273
2,975,899 A * 3/1961 Salomon et al. ..... 209/273
3,933,649 A * 1/1976 Ahlfors ..... 210/378
4,127,479 A * 11/1978 Kurth et al. ..... 209/273
4,302,327 A * 11/1981 Martin ..... 209/240
4,744,894 A * 5/1988 Gauld ..... 209/234
4,810,270 A * 3/1989 Terry et al. ..... 55/294
5,119,953 A * 6/1992 Atkeison et al. ..... 209/273
5,622,267 A * 4/1997 Hautala ..... 209/273
6,155,427 A * 12/2000 Pimley ..... 209/270

* cited by examiner

*Primary Examiner*—Donald P. Walsh
*Assistant Examiner*—Joseph C Rodriguez
(74) *Attorney, Agent, or Firm*—Manabu Kanesaka

(57) ABSTRACT

A screen apparatus includes a tank, a first cylidrical screen disposed inside the tank to form a first chamber, and a second cylidrical screen disposed outside the first cylindrical screen. The second cylindrical screen defines a second' chamber facing the first cylindrical screen and having upper and lower portions communicating with an inlet portion, and second" chamber. A connection member has a groove facing the second' chamber at an intermediate portion of the second cylindrical screen, and a passage communicating with the groove for discharging a paper stock. The paper stock flows to the second' chamber through the upper and lower portions. A part of the paper stock passing through the first and second cylindrical screens is discharged through first and second selection outlet portions, and a part of the paper stock not passing throught the first and second cylindrical screens is discharged through the passage.

6 Claims, 7 Drawing Sheets

SCREEN APPARATUS

BACKGROUND OF THE INVENTION

1. Field of the Invention

The present invention relates to a screen apparatus, and more particularly, to a screen apparatus which can increase a selecting processing amount of a paper stock.

2. Description of the Prior Art

There exists a screen apparatus in which a stirring member (e.g., foil, agitator or the like) is located outside of a cylindrical screen provided in a tank, a paper stock is allowed to flow from outside to inside of the screen, the paper stock is introduced to the screen from a portion of the screen located at one end surface and a portion thereof located at the other end surface, thereby solving or reducing "inconvenience that concentration becomes higher as the paper stock flows downstream of the screen" (e.g., see patent document 1).

[Patent document 1 Publication (KOKAI)No.12-8287 (FIG. 4)]

However, the above screen apparatus has a problem that there exists only a single cylindrical screen, and the screen apparatus is susceptible to improvement of a selecting processing amount of paper stock.

SUMMARY OF THE INVENTION

The present invention is achieved in view of the above problem, and it is an object of the invention to provide a screen apparatus which can increase a selecting processing amount of a paper stock.

To achieve the above object, a first aspect of the present invention provides a screen apparatus comprising: a tank having an inlet portion of a paper stock; a first selection outlet portion and a second selection outlet portion and receiving the paper stock; a first cylindrical screen whose one of end surfaces is closed and the other end surface is opened, the first cylindrical screen being provided at its side surface with a plurality of openings and being fixedly provided in the tank; a second cylindrical screen whose side surface is opposed to the side surface of the first cylindrical screen and whose both end surfaces are opened, the second cylindrical screen being provided at its side surface with a plurality of openings, the second cylindrical screen being fixedly provided in the tank; a first supporting member supported by one end of the second cylindrical screen and an inner wall of the tank; a second supporting member supported by the other end of the second cylindrical screen and an inner wall of the tank; wherein the second cylindrical screen is closed such that the paper stock enters the second cylindrical screen through the plurality of openings of the second cylindrical screen by the second supporting member and the first supporting member, an interior of the tank is divided into a first chamber and a second chamber by the first cylindrical screen, the second chamber is divided into a second' chamber and a second" chamber by the second cylindrical screen, the first chamber faces the first selection outlet portion, the second' chamber faces an inlet portion of the paper stock, the second" chamber faces the second selection outlet portion, the screen apparatus further comprises: a stirring member having stirring portions located inside of the second cylindrical screen and outside of the first cylindrical screen, the stirring member 3 being rotatably supported for stirring the paper stock in the second' chamber; a connection member having an opening which is in communication with the second' chamber formed between an inner side of the second cylindrical screen and an outer side of the first cylindrical screen, the connection member being mounted to the second cylindrical screen and in communication with the opening, the connection member having a passage for discharging out the paper stock, the connection member being provided in an intermediate portion of the second cylindrical screen; and a paper stock discharging passage which is in communication with the passage of the connection member and which has a passage for discharging the paper stock in the passage out from the tank.

According to a second aspect of the invention, in the first aspect, the connection member is a ring member which is in parallel to both end surfaces of the second cylindrical screen, and is located substantially at an intermediate portion between the both end surfaces, an outer side of the ring member swells toward an outer side of the second cylindrical screen, an inner side of the ring member forms a groove over the entire length of the ring member, a groove opening which is an opening of the groove is in communication with the paper stock discharging passage, the groove opening is provided in the wall.

According to a third aspect of the invention, in the first aspect, the inlet portion of the paper stock comprises: one inlet portion for a portion located at a position of one end surface formed between an inner side of the second cylindrical screen and an outer side of the first cylindrical screen; and the other inlet portion for a portion located at a position of the other end surface formed between the inner side of the second cylindrical screen and the outer side of the first cylindrical screen.

DESCRIPTION OF THE PREFERRED EMBODIMENT

Figure 1:
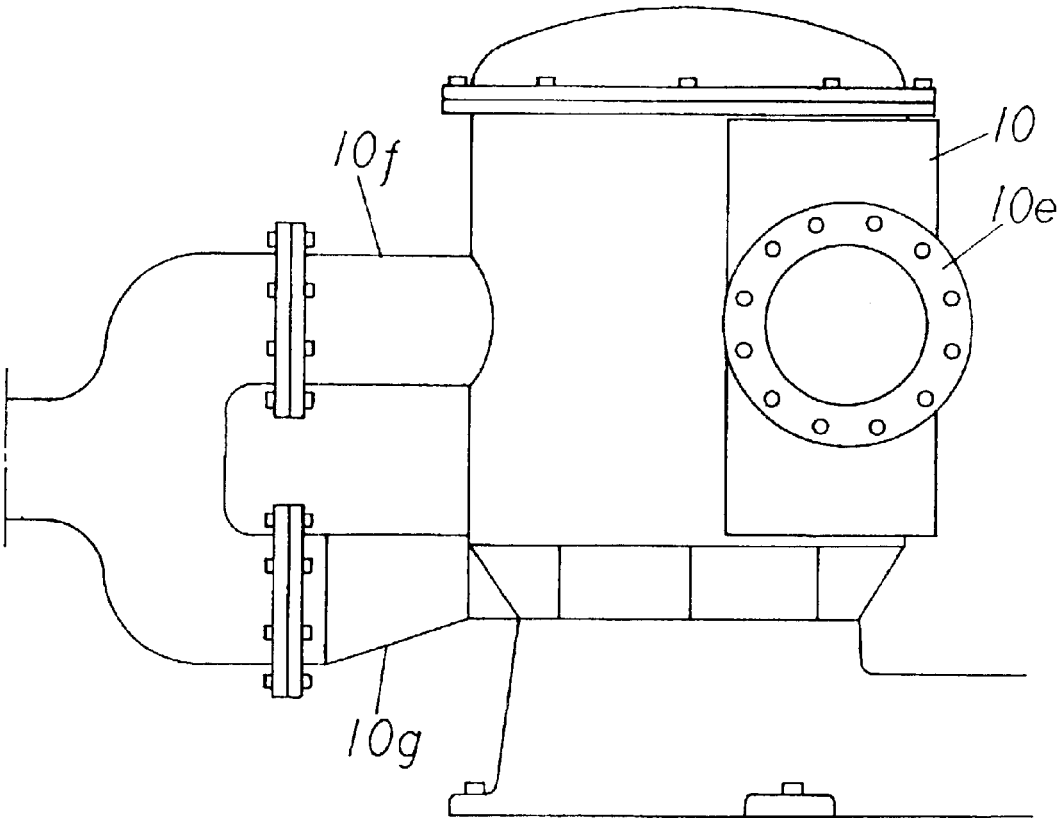
FIG. 1 is a schematic front view of a screen apparatus according to an embodiment of the present invention.

A screen apparatus of an embodiment of the present invention will be explained with reference to the drawings.

In FIGS. 1 to 7, a symbol A represents a screen apparatus. The screen apparatus A flows a paper stock from outside to inside of the screens 1 and 2, thereby eliminating foreign matter from the paper stock.

A reference number 10 represents a tank which receives the paper stock. The tank 10 includes inlet portions 10*a* and 10*b* of the paper stock, a first selection outlet portion 10*c* and a second selection outlet portion 10*d*.

The inlet portions of the paper stock are the inlet portions 10*a* and 10*b* of the paper stock for example. The inlet portions 10*a* and 10*b* of the paper stock are the inlet portion 10*a* which is an inlet to a portion located at one end surface formed between an inner side of the second cylindrical screen 2 and an outer side of the first cylindrical screen 1, and the other inlet portion 10*b* which is an inlet to a portion located at the other end surface formed between the inner side of the second cylindrical screen 2 and the outer side of the first cylindrical screen 1.

The inlet portions 10*a* and 10*b* of the paper stock are connected to an inlet pipe 10*e*.

The first selection outlet portion 10*c* and the second selection outlet portion 10*d* are respectively connected to a first selection outlet pipe 10*f* and a second selection outlet pipe 10*g*.

A reference number 1 represents the first cylindrical screen 1 fixed in the tank 10. One of end surfaces of the first cylindrical screen 1 is closed, the other end surface thereof is opened. The first cylindrical screen 1 is provided at its side surface with a plurality of openings. The openings are slits, round holes or rod-like members which are annularly arranged. In the case of the screen, the openings are clearances formed between adjacent rod-like members.

A reference number 2 represents a second cylindrical screen fixed in the tank 10. The second cylindrical screen 2 is located outside the first cylindrical screen 1. A side surface of the second cylindrical screen 2 is opposed to a side surface of the first cylindrical screen 1, and one end surface and the other end surface of the second cylindrical screen 2 are opened, and the side surface of the screen 2 is provided with a plurality of openings. Like the openings of the first cylindrical screen 1, the openings of the second cylindrical screen 2 are slits, round holes or clearances formed between adjacent rod-like members.

Figure 4:
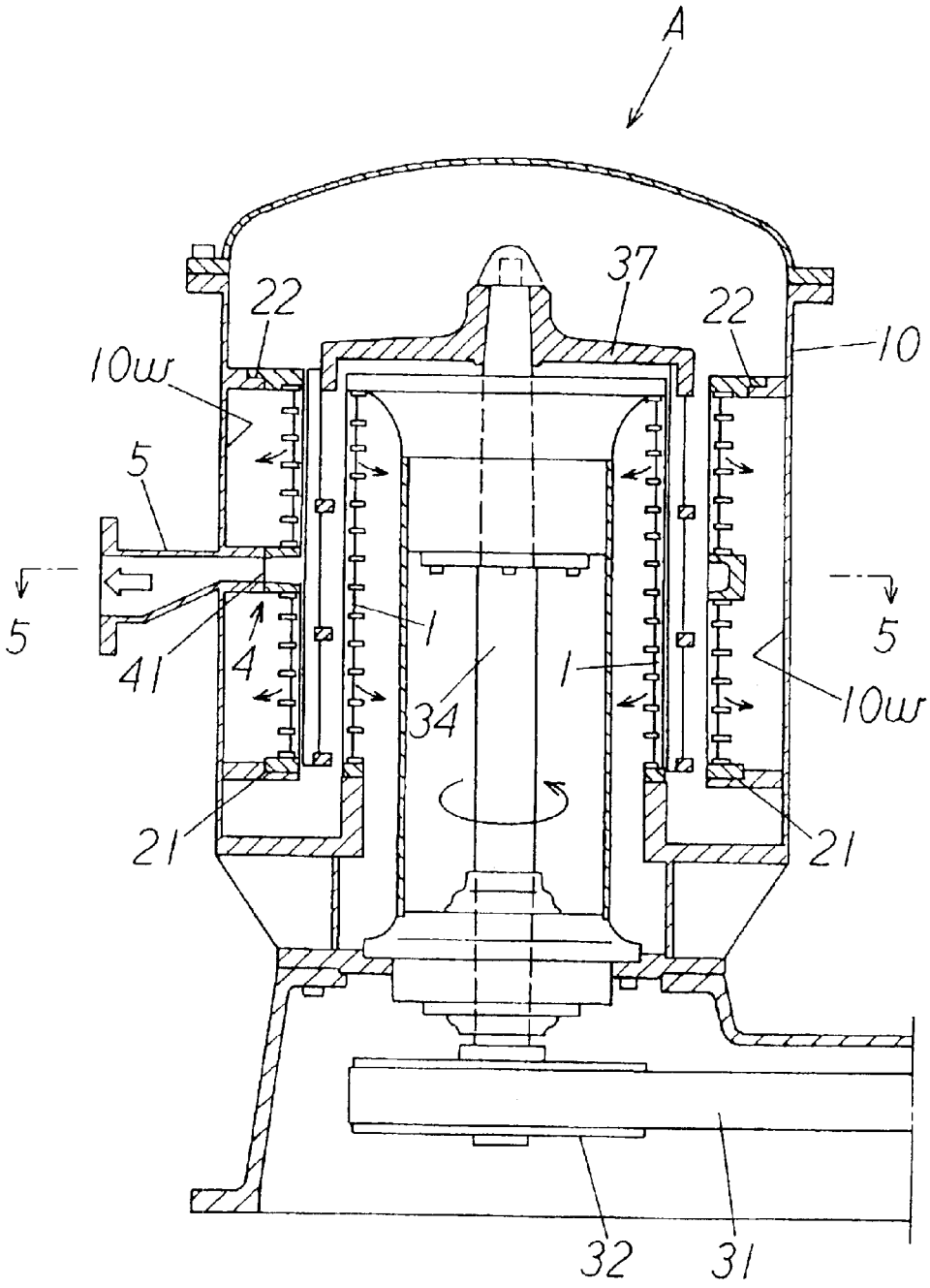
FIG. 4 is a schematic sectional view taken along a 4—4 line in FIG. 3.

As shown in FIG. 4, one of ends of the second cylindrical screen 2 and an inner wall 10*w* of the tank 10 are supported by a first supporting member 21. The other end of the second cylindrical screen 2 and the inner wall 10*w* of the tank 10 are supported at positions closer to a second supporting member 22.

Figure 2:
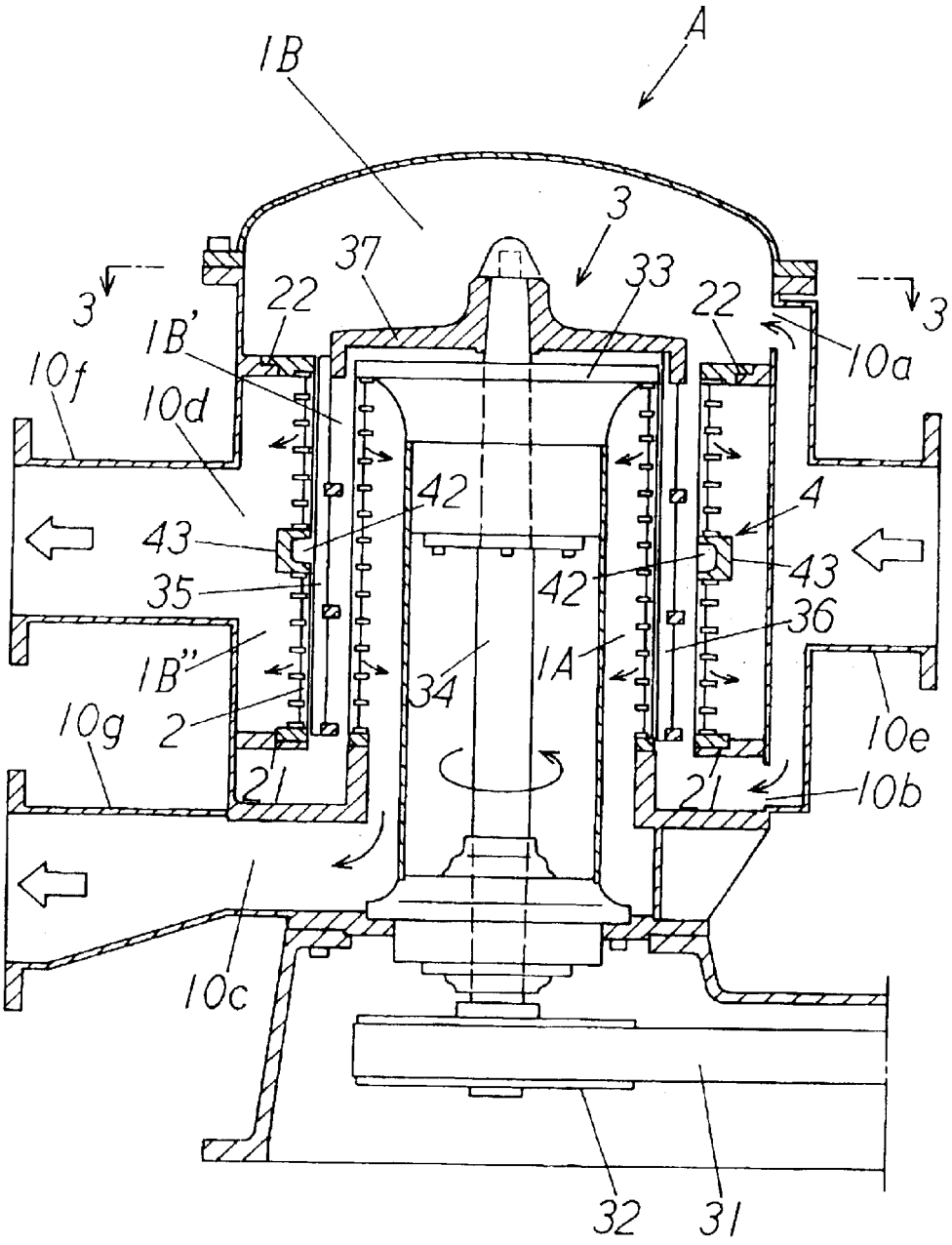
FIG. 2 is a schematic sectional view of the screen apparatus shown in FIG. 1.
Figure 3:
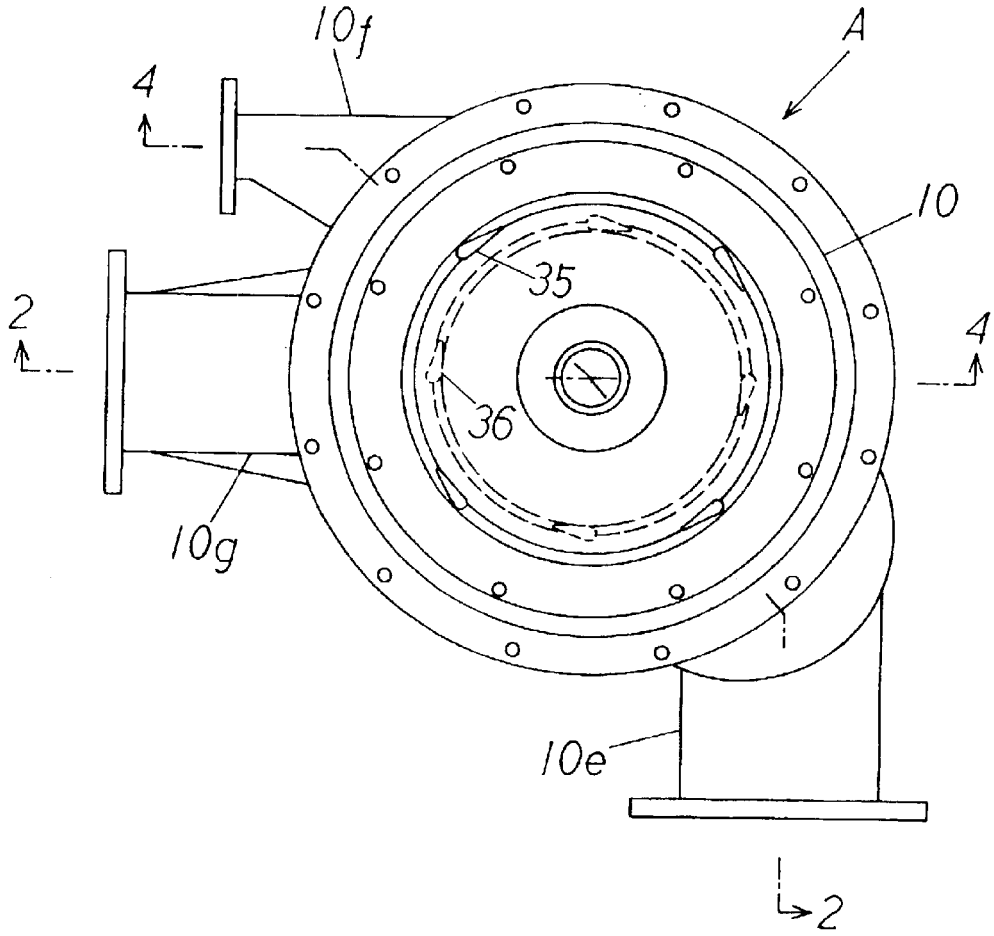
FIG. 3 is a schematic sectional view taken along a 3—3 line in FIG. 2.

The second cylindrical screen 2 is closed such that the paper stock enters the second cylindrical screen 2 through the plurality of openings of the second cylindrical screen 2 by the second supporting member 22 and the first supporting member 21 (see FIGS. 2 and 4). FIG. 2 is a schematic sectional view taken along a 2—2 line in FIG. 3.

Therefore, as shown in FIG. 2, an interior of the tank 10 is defined into a first chamber 1A and a second chamber 1B by the first cylindrical screen 1 in a flow of the paper stock. The second chamber 1B is defined into a second' chamber 1B' and a second" chamber 1B" by the second cylindrical screen 2. The first chamber 1A communicates with the first selection outlet portion 10*c*, the second' chamber 1B' communicates with the inlet portions 10*a* and 10*b* of the paper stock, and the second" chamber 1B" communicates with the second selection outlet portion 10*d*.

A reference number 3 represents a stirring member having stirring portions 35 and 36 located inside of the second cylindrical screen 2 and outside of the first cylindrical screen 1. The stirring member 3 is rotatably supported, and stirs the paper stock in the second' chamber 1B'. The stirring member 3 is rotated by a belt 31 from a motor (not shown), a pulley 32 and a rotation shaft 34 which passes through a closed portion 33 of the second cylindrical screen 2. The stirring portions 35 and 36 of the stirring member 3 are mounted such as to be hung from a disk 37 mounted to the rotation shaft 34 for example.

The hanging stirring portions 35 and 36 are located between the first cylindrical screen 1 and the second cylindrical screen 2. The stirring portion 35 is provided in the vicinity of the second cylindrical screen 2, and the stirring portion 36 is provided in the vicinity of the first cylindrical screen 1.

The stirring portions 35 and 36 are foils or agitator, and they are rotated in the vicinity of the first cylindrical screen 1 (or second cylindrical screen 2). When the stirring portions 35 and 36 are foils, a positive pressure is generated against the first cylindrical screen 1 (or second cylindrical screen 2) at a front portion of the foil, and a negative pressure is generated at a rear portion of the foil, thereby cleaning the first cylindrical screen 1 (or second cylindrical screen 2).

A reference number 4 represents a connection member having an opening 41 which comes into communication with the second' chamber 1B' formed between the inner side of the second cylindrical screen 2 and the outer side of the first cylindrical screen 1. The connection member 4 is mounted to the second cylindrical screen 2 and comes into communication with the opening 41, includes a passage (e.g., later-described groove 42) through which the paper stock in the second' chamber 1B' is discharged, and is provided in an intermediate portion of the second cylindrical screen 2.

Figure 5:
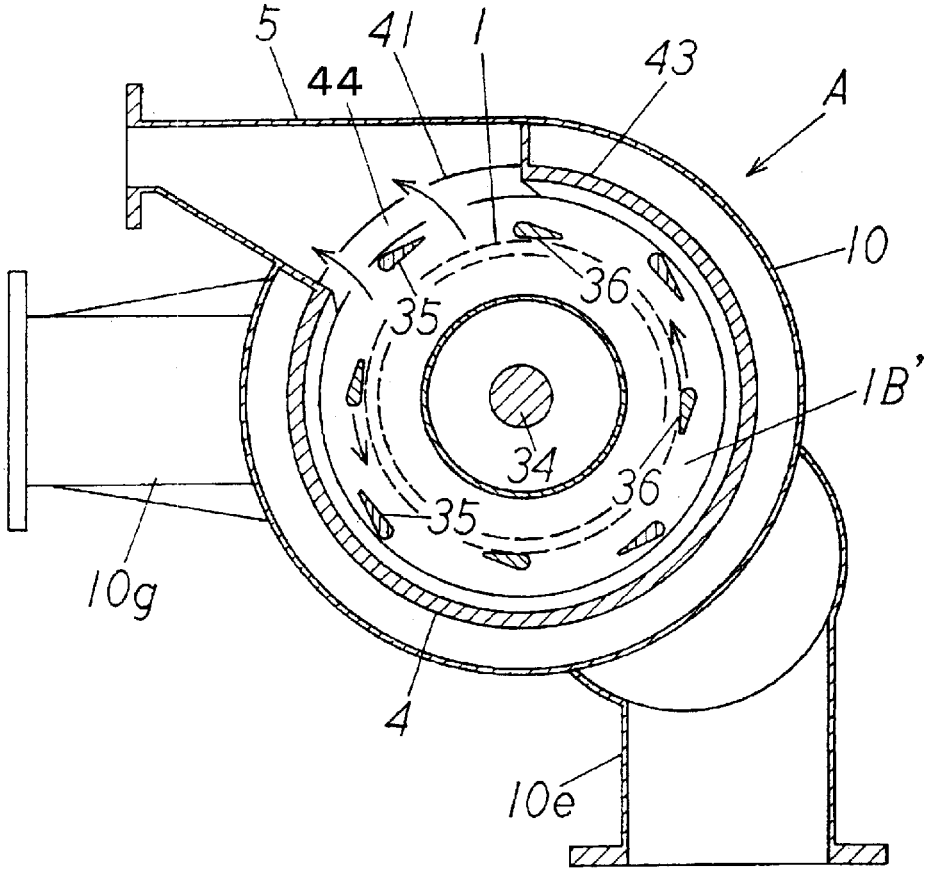
FIG. 5 is a schematic sectional view taken along a 5—5 line in FIG. 4
Figure 6:
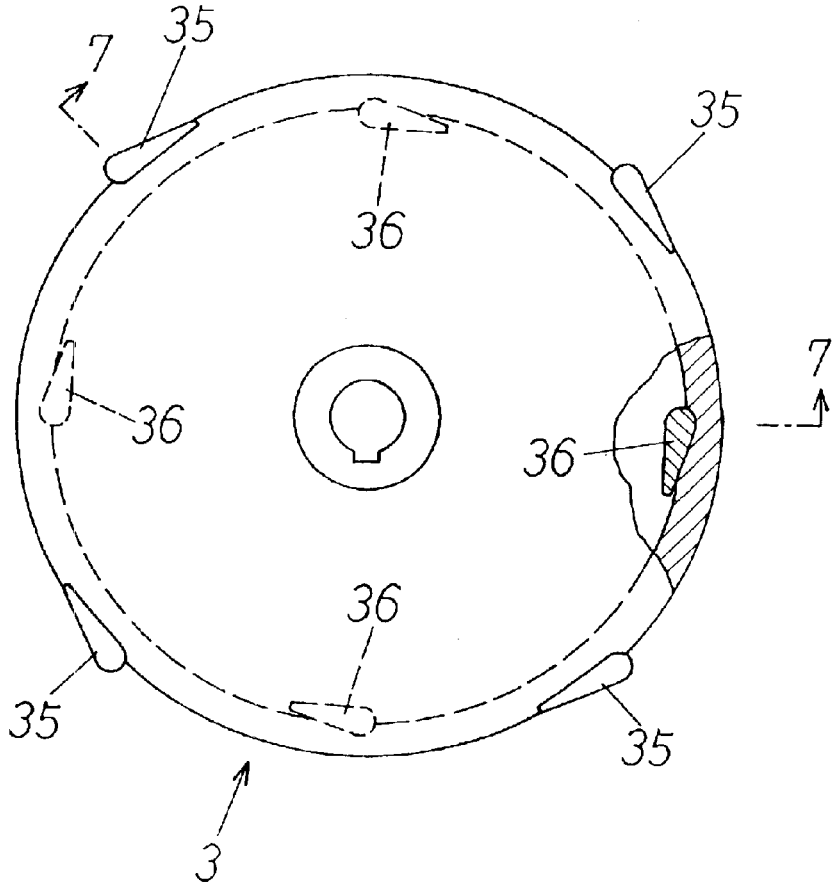
FIG. 6 is a schematic plan view of a stirring member incorporated in FIG. 1.
Figure 7:
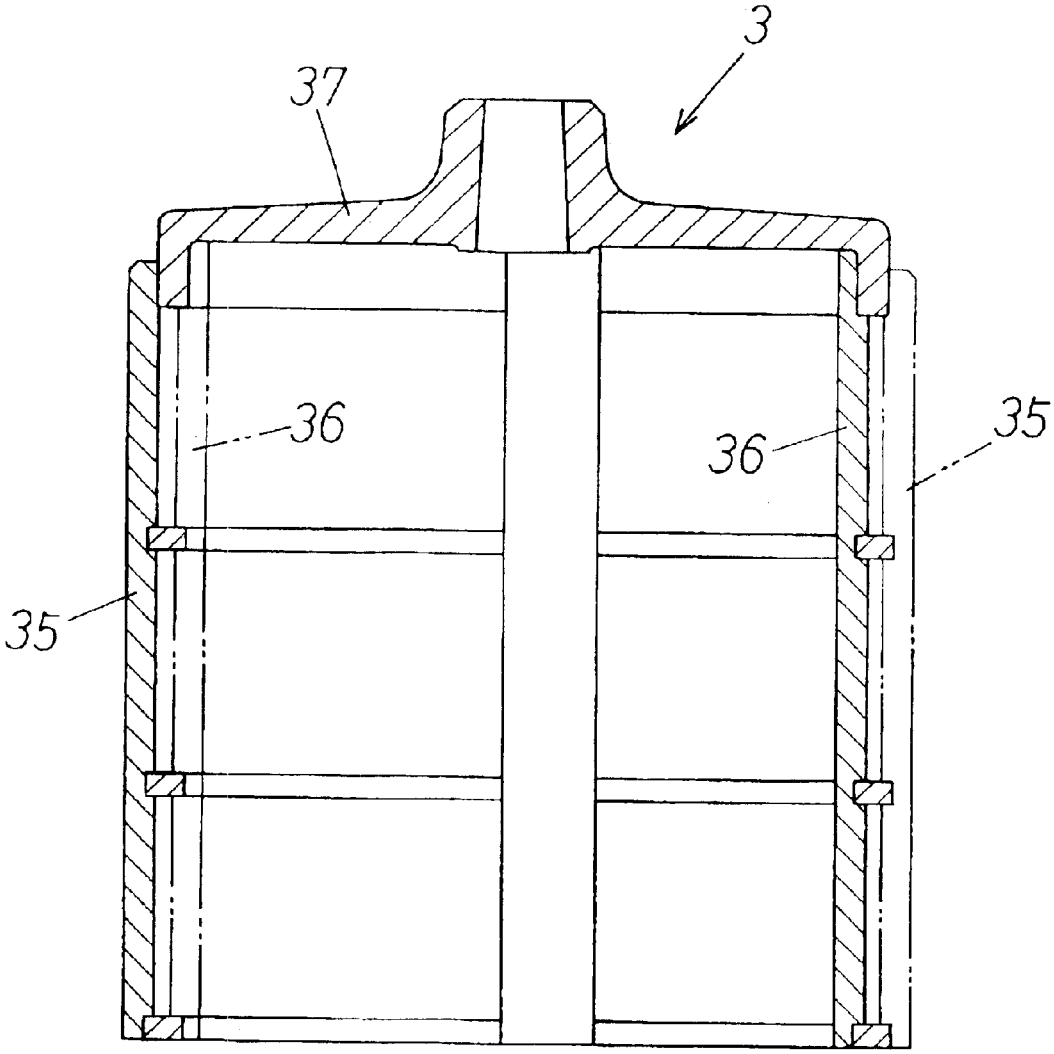
FIG. 7 is a schematic sectional view taken along a 7—7 line in FIG. 6.

The connection member 4 is preferably a ring member which is in parallel to one of end surfaces and the other end surface of the second cylindrical screen 2, and is located substantially at an intermediate portion between the one end surface and the other end surface. As shown in FIGS. 4 and 5, an outer side of the ring member swells toward an outer side of the second cylindrical screen 2, an inner side of the ring member forms a groove 42 over the entire length (substantially entire periphery), a groove opening 44 which is an opening of the groove 42 is in communication with the paper stock discharging passage 5, and the groove opening 44 is formed in the wall 43.

A reference number 5 represents the paper stock discharging passage 5. The paper stock discharging passage 5 is in communication with a passage of the connection member 4, and includes a passage through which the paper stock in the passage, i.e., paper stock including great amount of foreign matter is discharged out from the tank 10.

Therefore, if the paper stock is introduced into the first cylindrical screen 1 and the second cylindrical screen 2 from a portion located at the one end surface formed between the inner side of the second cylindrical screen 2 and the outer side of the first cylindrical screen 1 and from a portion located at the other end surface, respectively, the paper stock flows toward the connection member 4, and during that time, good fiber passes through the first cylindrical screen 1 and the second cylindrical screen 2 and is introduced out from the tank 10 through the first selection outlet pipe 10*f* and the second selection outlet pipe 10*g*, respectively. At that time, the first cylindrical screen 1 is cleaned by the stirring portion 36 of the stirring member 3 and the second cylindrical screen 2 is cleaned by the stirring portion 35 of the stirring member 3, and clogging is prevented.

Further, paper stock having great amount of foreign matters which can not pass through the first cylindrical screen 1 and the second cylindrical screen 2 is effectively collected in the groove 42 formed over substantially the entire length of the inside of the ring member (connection member 4), and is ejected from the tank 10 through the groove opening 44 and the paper stock discharging passage 5.

As a result, according to the screen apparatus A, the selecting processing amount of the paper stock is increased by the first cylindrical screen 1 and the second cylindrical screen 2 provided in the tank 10, the paper stock is introduced to the first cylindrical screen 1 and the second cylindrical screen 2 from the portion located at the one end surface formed between the inner side of the second cylindrical screen 2 and the outer side of the first cylindrical screen 1 and from the portion located at the other end surface, so that it is possible to solve the "inconvenience that concentration is increased as the paper stock goes downstream of the screen".

Further, the connection member 4, which is a ring member, is in parallel to the one of end surfaces and the other end surface of the second cylindrical screen 2, and is located substantially at an intermediate portion between the one end surface and the other end surface. The connection member 4 includes the wall 43 swelling outward. Therefore, paper stock having great amount of foreign matters which can not pass through the first cylindrical screen 1 and the second cylindrical screen 2 is effectively collected in the groove 42 formed over substantially the entire length of the inside of the ring member 4, and dust-eliminating effect can be enhanced.

According to the first aspect of the present invention, the selecting processing amount of the paper stock is increased by the first cylindrical screen and the second cylindrical screen provided in the tank, the paper stock is introduced to the first cylindrical screen and the second cylindrical screen from the portion located at the one end surface formed between the inner side of the second cylindrical screen and the outer side of the first cylindrical screen and from the portion located at the other end surface, so that it is possible to solve the "inconvenience that concentration is increased as the paper stock goes downstream of the screen".

According to the second aspect of the invention, in addition to the effect of the first aspect, the connection member is the ring member which is in parallel to the one of end surfaces and the other end surface of the second cylindrical screen, and is located substantially at an intermediate portion between the one end surface and the other end surface. The connection member includes the wall swelling outward. Therefore, paper stock having great amount of foreign matters which can not pass through the first cylindrical screen and the second cylindrical screen is effectively collected in the groove formed over substantially the entire length of the inside of the ring member, and dust-eliminating effect can be enhanced.

What is claimed is:

1. A screen apparatus comprising:

a tank having an inlet portion of a paper stock, a first selection outlet portion and a second selection outlet portion, a first cylindrical screen disposed inside the tank and having a plurality of openings at a side surface thereof so that the first cylindrical screen divides the tank into a first chamber inside the first cylindrical screen communicating with the first selection outlet portion and a second chamber outside the first cylindrical screen, a second cylindrical screen disposed inside the tank to be located outside the first cylindrical screen, said second cylindrical screen facing the first cylindrical screen and having a plurality of openings so that the second cylindrical screen divides the second chamber into a second' chamber facing the first cylindrical screen and having upper and lower portions communicating with the inlet portion and a second" chamber communicating with the second selection outlet portion, a stirring member having stirring portions located inside the second cylindrical screen and outside the first cylindrical screen, said stirring member being rotatably supported for stirring the paper stock in the second' chamber, a connection member formed at an intermediate portion of the second cylindrical screen and having a groove communicating with the second' chamber between the second cylindrical screen and the first cylindrical screen, and a passage communicating with the groove for discharging the paper stock, and a paper stock discharging passage connected to the passage of the connection member so that the paper stock entering into the tank through the inlet portion flows to the second' chamber through the upper and lower portions thereof, a part of the paper stock passing through the first and second cylindrical screens being discharged through the first and second selection outlet portions, and a part of the paper stock not passing through the first and second cylindrical screens flowing to the opening and being discharged through the passage from the tank.

2. The screen apparatus according to claim 1, wherein said second" chamber is generally defined by the second cylindrical screen and an outside wall of the tank, and the first chamber is generally defined by the first cylindrical screen and an inside wall of the tank.

3. The screen apparatus according to claim 2, further comprising a first supporting member for connecting an upper end of the second cylindrical screen and the outside wall of the tank, and a second supporting member for connecting a lower end of the second cylindrical screen and the outside wall of the tank.

4. The screen apparatus according to claim 2, wherein said connection member is a ring member disposed parallel to two lateral ends of the second cylindrical screen, said ring member having an outer side projecting toward an outer side of the second cylindrical screen, an inner side forming said groove over an entire length thereof, and a groove opening connecting the groove and the paper stock discharging passage, said groove opening being provided in the outside wall.

5. The screen apparatus according to claim 2, wherein said second chamber further includes an upper chamber portion and a lower chamber portion located at upper and lower sides of the second' chamber, said upper and lower chamber portions communicating with the inlet portion to provide the paper stack to the second' chamber through the upper and lower chamber portions.

6. The screen apparatus according to claim 5, wherein said connection member only ejects the paper stack not flowing through the first and second cylindrical screens from the tank.

* * * * *